United States Patent [19]

Sivilotti et al.

[11] Patent Number: 4,613,414

[45] Date of Patent: Sep. 23, 1986

[54] METHOD FOR MAGNESIUM PRODUCTION

[75] Inventors: Olivo G. Sivilotti, Kingston, Canada; Junkichi Iseki, Amagasaki, Japan

[73] Assignee: Alcan International Limited, Montreal, Canada

[21] Appl. No.: 719,641

[22] Filed: Apr. 4, 1985

Related U.S. Application Data

[63] Continuation of Ser. No. 565,905, Dec. 27, 1983, abandoned.

[30] Foreign Application Priority Data

Dec. 30, 1982 [GB] United Kingdom ..... 8236996

[51] Int. Cl.[4] ..... C25C 3/04; C25C 7/06

[52] U.S. Cl. ..... 204/70; 204/244; 204/245; 204/284; 204/268

[58] Field of Search ..... 204/70, 243 R–247, 204/284, 268

[56] References Cited

U.S. PATENT DOCUMENTS

| | | | |
|---|---|---|---|
| 1,569,606 | 1/1926 | Ashcroft | 204/244 X |
| 2,862,863 | 12/1958 | Griffith | 204/247 X |
| 2,959,533 | 11/1960 | De Varda | 204/244 |
| 3,909,375 | 9/1975 | Holliday et al. | 204/70 X |
| 4,409,083 | 10/1983 | Upperman et al. | 204/70 X |

FOREIGN PATENT DOCUMENTS

| | | | |
|---|---|---|---|
| 290951 | 3/1971 | U.S.S.R. | 204/245 |

*Primary Examiner*—Donald R. Valentine

*Attorney, Agent, or Firm*—Cooper, Dunham, Griffin & Moran

[57] ABSTRACT

An electrolytic cell for metal, particularly Mg, production includes a cathode or intermediate bipolar electrode having a cathodic face provided with a plurality of small cavities shaped to trap droplets of molten metal formed during electrolysis. The cavities help the metal droplets to coalesce and reduce the extent of back reaction with e.g. chlorine generated at the anode.

7 Claims, 3 Drawing Figures

METHOD FOR MAGNESIUM PRODUCTION

This is a continuation of application Ser. No. 06/565,905, filed Dec. 27, 1983, now abandoned.

This invention relates to electrolytic cells of the kind which produce metals in the molten state by electrolysis of a fused electrolyte containing a salt of the metal in question. The invention is applicable to cells for the production of metals (such as aluminium) which are more dense than the electrolyte; and to cells for the production of metals (such as magnesium) which are less dense than the electrolyte. The electrolyte for such cells is a molten salt, conventionally a molten mixture of alkali and alkaline earth metal halides containing in solution a halide, e.g. the chloride, of the metal in question. The invention is applicable to cells for electro-winning or electrorefining of metals.

Typically, cells for the production of metals such as magnesium or aluminium comprise facing anode and cathode surfaces defining an interelectrode space through which the electrolyte is caused to flow. Chlorine is generated at the anode surface and molten metal is generated at the cathode surface and flows with the electrolyte to a metal recovery zone. If the metal and the chlorine come into contact, they tend to recombine which reduces the current efficiency. Recombination can be reduced or prevented by separating the facing anode and cathode surfaces, but this increases the internal resistance of the cell. In the metal recovery zone, separation of metal from electrolyte is generally effected by sedimentation, advantage being taken of the differing densities of the metal and the electrolyte.

Electrolytic cells of the kind described are frequently designed as multipolar cells, that is to say, cells with at least one electrode assembly of a cathode and an anode and at least one intermediate bipolar electrode. Intermediate bipolar electrodes are valuable in that they increase the effective cathode area on which metal formation can take place without either increasing the size of the cell or increasing the heat and power loss involved in providing large numbers of external electrical connections.

For molten chloride electrolytes which generate chlorine at the anode surface, it is usual to construct the anode of graphite, a material which can resist the prevailing conditions, in order to achieve good performance at acceptable cost. It is convenient, and indeed quite usual, to use graphite slabs as intermediate bipolar electrodes, so that both anode and cathode faces are of graphite, but this gives rise to a problem, because graphite is known to be non-wetting for metals such as magnesium and aluminium.

Non-wetting cathodic surfaces tend to release molten metal droplets at a very early stage of formation due to the near absence of the surface tension force and to the high drag forces from the fast flow of electrolyte across the cathode face. The production of metal droplets substantially less and 1 mm diameter leads to loss of current efficiency for two reasons:

(a) Small droplets undergo substantial back-reaction with chlorine. The back-reaction is proportional to the specific surface of the droplets and the specific surface is inversely proportional to the average diameter of the droplets.

(b) Separation of metal by sedimentation (or flotation) of small droplets in a metal recovery zone is less efficient. Indeed, droplets below a certain size are entrained in the flowing electrolyte and recycled to the electrolysis zone where further back-reaction with chlorine occurs.

Because of this problem it has been quite usual to construct cathode surfaces of such cells of iron. Thus, USSR Pat. Nos. 432230 and 588261 describe magnesium electrolytic cells containing bipolar electrodes having graphite anode faces and iron cathode faces joined together by prongs. A few large apertures in the iron cathode faces permit molten magnesium metal to flow between the graphite and the iron and maintain good electrical contact between them; and channels machined within the graphite may permit removal of magnesium from the electrolysis region as it is formed.

But bipolar electrodes having iron and graphite faces are mechanically complex to make and instal, due among other things to the different rates of thermal expansion of iron and graphite. It would be convenient to be able to use graphite slabs as bipolar electrodes. But the problem remains of providing cathode surfaces which release metal only after the droplets have reached a sufficient size to minimise back-reaction and facilitate recovery.

The present invention provides an electrolytic cell for metal production, including an electrode having a face provided with a plurality of small cavities shaped to trap droplets of molten metal formed during electrolysis.

The electrode face where metal is formed in a molten state will normally be cathodic.

The electrode may be the cathode of the cell. Alternatively, the electrode may be an intermediate bipolar electrode. In this embodiment, the invention provides a multipolar electrolytic cell for metal production, including at least one electrode assembly of a cathode and an anode and at least one intermediate bipolar electrode having a face provided with a plurality of small cavities shaped so as to trap droplets of molten metal formed thereon during electrolysis.

There are two advantages that may be gained together or separately by means of the invention. One is that the molten metal collected in the cavities can be protected from the electrolyte, and particularly from back-reaction with chlorine and other reactive species from the anode. This protection is achieved, not only in the cavities, but also after the molten metal has left the cavities entrained in the electrolyte. To achieve this advantage it is not necessary, though it is preferred, that the cavities form a close-packed array, nor that they eventually become filled with molten metal. It is merely necessary that molten metal droplets should collect and coalesce in the cavities.

The other advantage is that the electrode face can become, for practical purposes, a surface composed of the molten metal in question. Thus, an electrode face having unsatisfactory properties may be converted during use into one having improved properties. For example, an electrode or graphite, having non-wetting properties for metals such as magnesium and aluminium, can be converted during use into one having a surface with wetting properties. This advantage may be useful in electrolytic cells of various kinds, not just the multipolar cells for Al or Mg production discussed above. To achieve this advantage, it is necessary that the cavities form a close-packed array and that they eventually become filled with molten metal, preferably so that menisci of the metal project beyond the front surface of the solid electrode.

The cavities are shaped and positioned so as to tend to trap moving metal droplets or retain droplets that are generated by electrolysis at the mouth of the cavities themselves. These metal droplets have time to coalesce with each other, so that eventually the cavities become filled with molten metal. Subject to electrolyte drag forces, the metal droplets will separate periodically from the molten metal mini-pools and will become entrained by the circulating electrolyte. These droplets will be of a rather uniform dimension and will be an order of magnitude bigger than those generated on a non-wetting graphite-faced cathode.

This invention is applicable to cells of the type in which electrodes are superimposed, with substantially horizontal facing cathode and anode surfaces. However, it is more particularly applicable to cells in which the electrodes are positioned side-by-side, with substantially vertical facing cathode and anode surfaces. The number of electrode assemblies in a cell is not critical, and may typically be from 1 to 6. The number of intermediate bipolar electrodes in each assembly of multipolar cells may conveniently be in the range of 1 to 12. The number is not critical except for the fact that the heat balance of the cell has to be satisfied in the design i.e. the total heat generated by the electrolysis has to be in equilibrium with the total heat that can be dissipated through the cell boundaries or via other means that might be provided to extract excess heat. The advantages of the invention are achieved particularly when the intermediate bipolar electrodes are composed of slabs of graphite.

The small cavities should extend over a major, preferably the entire, portion of the cathode surface over which molten metal is generated. The cavities are preferably close-packed, rather than being spaced apart, so that there are at least 0.2/cm and preferably from 0.5/cm to 10/cm, measured in the direction of electrolyte flow.

Various shapes of cavity are envisaged. The cavities may be in the form of small holes. Alternatively, the cavities may take the form of grooves extending across the cathode surface transverse or substantially transverse to the direction of flow of electrolyte over it.

The grooves may be arranged in the cathodic surface at such an angle that the molten metal tends to flow along them. Means may be provided for collecting molten metal at the downstream ends of such grooves. To accommodate such flow of molten metal, the size of the grooves may be increased towards their downstream ends. Depending on the angle of the grooves, either all the molten metal may be removed as droplets entrained in the flowing electrolyte; or all the molten metal may be removed by flow along the grooves and collection at their downstream ends; or as is preferred, the molten metal may be removed by a combination of the two mechanisms.

The cavities are not inter connected within the body of the electrode. In order to more effectively trap molten metal, the wall of the cavity facing the flowing electrolyte may be overhung, e.g. by from 0° to 40°, preferably from 5° to 25°.

The size of each cavity is preferably such that a substantial proportion of it is filled with molten metal during electrolysis. The amount of metal retained in a small cavity depends to some extent on the surface tension of the metal. The cavities preferably have a dimension at their outer ends, measured in the direction of flow of the electrolyte, of less than 2 cm, preferably from 0.5 to 5 mm. The cavities are preferably less than 2 cm, and preferably from 1 to 10 mm, deep. Deeper cavities cost more to form and would not give rise to any significant advantage. The number of cavities will depend on the size and shape of each cavity, and on the size of the cathode surface, but will in any event be greater than, and preferably substantially greater than, 10.

The cavities may be tapered towards their inner ends. At their outer ends, the cavities will usually have an aggregate area of at least 20%, preferably at least 40%, of the total cathode surface area. If the cavities are sufficiently close-packed and they occupy a substantial fraction of the active surface of a graphite cathode, the latter will act as a metallic body rather than as a graphite body and electrolysis will take place mainly on the molten metal surfaces protruding from the mouths of the cavities.

Close-spaced cavities can be obtained by gang drilling or punching small holes in the cathodic face of a graphite electrode, the holes being properly sloped to entrap metal. An array of parallel grooves can be formed by moving a multi-toothed rotating tool across the surface of a stationary graphite slab. Alternatively, it is possible to provide a multi-toothed tool arranged like a stationary comb, which is fed gradually down into the graphite slab which is reciprocated back and forth by the machine tool table.

Interelectrode spacings of cells according to this invention, and operating parameters such as electrolyte temperature and current density, can be conventional. However, the invention is particularly useful in those cells where the electrodes are arranged substantially vertically, and which operate at high current density and small interelectrode spacing, so that chlorine generated at the anode provides a substantial amount of gas lift. Two such cells for magnesium production are described in our co-pending British Patent Applications Nos. 8217165 (filed 14th June 1982) and 8222665 (filed 6th Aug. 1982). These cells are preferably operated at a temperature of 655° C. to 695° C., particularly 660° C. to 670° C., a current density of from 0.3A/cm$^2$ to 1.5A/cm$^2$; and an interelectrode spacing of from 4 mm to 25 mm. Under these conditions, the internal resistance of the cell is rather low; provided the magnesium metal droplets generated are of sufficient size, back-reaction of magnesium with chlorine is also rather low and current efficiency correspondingly high.

When the cavities are in the form of a uniform array of closely-spaced grooves, each intermediate bipolar electrode (after installation in the cell in a substantially vertical position) will have its cathodic face covered by grooves directed in a substantially horizontal direction. To minimize the release of metal in the interelectrode space where the mixture of electrolyte with chlorine will promote the back reaction, the grooves may be made to slope upwards and towards the side of the cathode where a vertical passage may be located for the release of the metal from the ends of the grooves; the metal therefore can rise in a way that is the least disturbed by the chlorine stream. The slope of the grooves may be conveniently selected between 0.2 to 2%, preferably between 0.5 to 1%, but always such as to be insufficient to promote a side flow of magnesium fast enough to empty the grooves before they can be filled by the metal being produced by electrolysis. This provision is particularly beneficial if applied to a cell where the circulation of the electrolyte is designed to take place in the plane of the interelectrode spaces, such as described in our co-pending British Patent Application No. 8217165; in this case, the side selected for the release of the metal is the one closest to the metal collecting chamber, so that the time required to evacuate the metal from the top of the electrolysis chamber is minimized.

Reference is directed to the accompanying drawings, in which.

Figure 1:
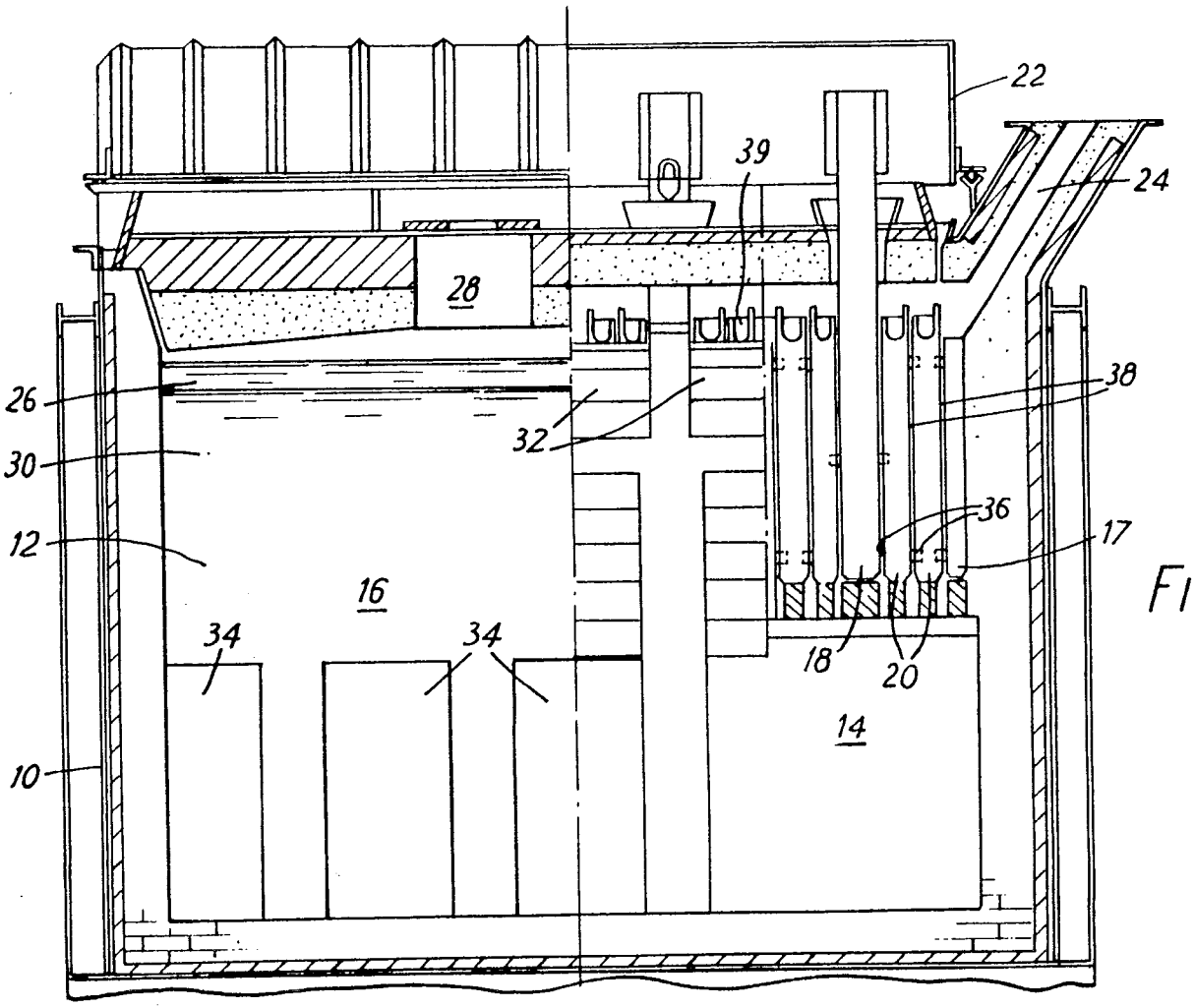
FIG. 1 is a diagramatic sectional front elevation of a multipolar electrolytic cell according to the invention; (the right half section taken through the electrolysis zone and the left half section through the metal recovery zone).

Referring to FIG. 1, a vessel 10 of refractory lined steel contains the electrolyte. An internal partition 12, of refractory construction, divides the cell into two zones, an electrolysis zone 14 (shown on the right hand side of the Figure) and a metal recovery zone 16 (shown on the left hand side of the Figure) positioned in front of the electrolysis zone. In the electrolysis zone, are electrode assemblies, each consisting of a cathode 17, an anode 18 and intermediate bipolar electrodes 20. A cover 22 protects the cell from the atmosphere and a vent 24 is provided to collect the chlorine generated during electrolysis.

In the metal collection zone 16, quiescent conditions are maintained and the liquid separates into two layers, a molten metal layer 26, which is removed from time to time through a port 28, and an electrolyte layer 30. The partition 12 has apertures 32, 34. The apertures 32 are positioned at about the level of the surface of the electrolyte, and permit passage of an electrolyte/metal mixture from the electrolysis zone 14 to the metal collection zone 16. The other apertures 34 are positioned near the bottom of the cell and permit the return of electrolyte from the metal collection zone 16 to the electrolysis zone 14.

In operation, an electric current is passed between the cathode 17 and the anode 18. Molten metal is generated at the cathode 17 and the cathode surfaces 36 of the intermediate bipolar electrodes 20. Chlorine is generated at the anode 18 and at the anode surfaces 38 of the intermediate bipolar electrodes 20. The generated chlorine acts as a pump to cause an electrolyte/metal mixture to stream upwards in the spaces between the electrodes. The mixture reaching the surface is caused to flow along troughs 39 (in the tops of the intermediate bipolar electrodes 20), over a weir (not shown) and through the apertures 32 into the metal collection zone 16. Molten metal is removed at 28 and chlorine gas at 24. The system is maintained by the addition as necessary of further supplies of metal chloride (by means not shown).

Figure 2:
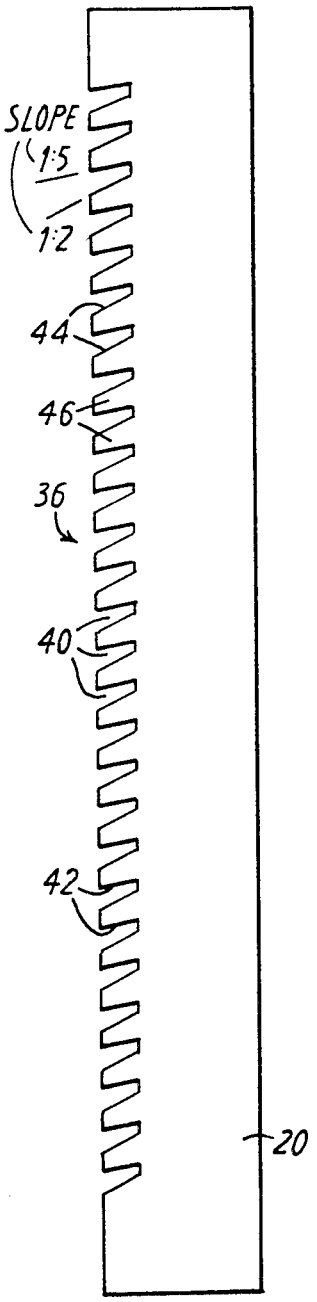
FIG. 2 is a magnified view, taken in the same direction, of part of one of the intermediate bipolar electrodes.

FIG. 2 shows part of the cathode surface 36 of one of the intermediate bipolar electrodes 20. The surface is provided with a plurality of small grooves 40 which extend horizontally across the entire width of the electrode. The upper edge of each groove 42 overhangs at a slope of 1 in 5. The lower edge of each groove 44 has a slope of 1 in 2. The width of each groove 40, measured in a vertical direction, is 2 mm. The width of each rib 46 between the grooves measures 2 mm at its outer end. Each groove is 4 mm deep. There are 2.5 grooves per centimeter, measured in the vertical direction of flow of the electrolyte.

In operation, molten metal formed on the cathode surface 36 becomes trapped in the cavities 40 and collects there so as to substantially fill the cavities and provide a projecting meniscus of molten metal. From time to time a metal droplet is removed from the cavity by the drag of the electrolyte flowing past. The size of the droplet depends on the nature of the metal, the dimensions of the cavities and the speed of flow of the electrolyte, but is typically about 1 mm diameter.

Figure 3:
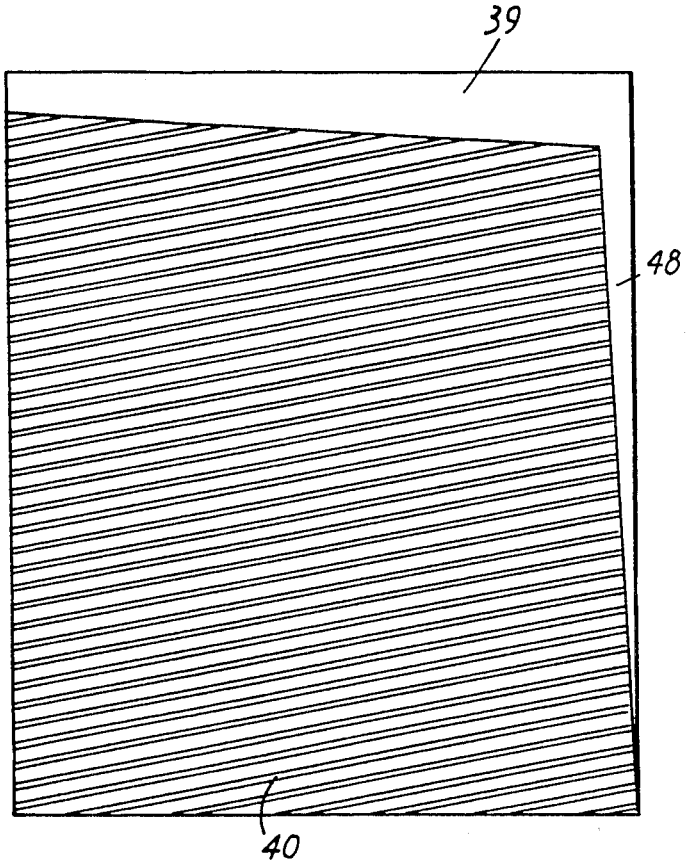
FIG. 3 is a front view of the cathode surface of a bipolar electrode in which the grooves are arranged at an angle to the (vertical) direction of flow of electrolyte.

FIG. 3 is a front view of the cathode surface 36 of one of the intermediate bipolar electrodes 20. The surface is provided with a plurality of small grooves 40 which extend across substantially the entire width of the electrodes. The dimensions of the grooves are as stated for those of FIG. 2. However the grooves, unlike those of FIG. 2, are arranged at a small angle to the horizontal. A vertical passage 48 is provided at the downstream ends of the grooves 40 to convey molten metal up to the surface. A sloping channel 39 is provided along the tops of the electrode. This design of bipolar electrode is particularly suitable for use in the electrolytic cell of FIG. 1.

In use, most of the metal flows sideways along the slight slope of the grooves 40, is released from time to time into the channel 48 at the end of the cathodic face adjacent to partition 12 of FIG. 1 and rises to the surface of the electrolyte near the apertures 32 also of FIG. 1. From there it is easily carried through to the metal collection zone 16 where it separates into the layer 26. The metal droplets removed from the cavities by the drag of the electrolyte flowing past also rise to the surface of the electrolyte and are carried towards the metal collecting zone via the top channels 39 provided on top of the electrodes to circulate the electrolyte towards the apertures 32.

Other electrolyte circulation patterns could be used, such as those based on the flow of electrolyte across the tops of the electrodes, and other methods of releasing the metal from the cavities could be implemented, without departing from the spirit of the invention.

We claim:

1. A method of making magnesium by the use of an electrolytic cell including at least one electrode assembly of a cathode and an anode and at least one intermediate bipolar electrode having a cathodic face, said assembly defining substantially vertical interelectrode spaces, which method comprises providing a chloride-based electrolyte which is more dense than the magnesium and passing an electric current between the anode and the cathode, whereby molten magnesium is produced at the cathodic face of the at least one intermediate bipolar electrode and electrolyte flows over the said cathodic face in an upward direction, wherein the said cathodic face is provided with a plurality of small cavities which trap droplets of molten magnesium formed thereon during electrolysis.

2. A method according to claim 1, wherein the cavities form a closed packed array.

3. A method according to claim 1, wherein the cavities are shaped to become filled with molten metal during operation of the cell.

4. A method according to claim 1, wherein the cavities are small holes.

5. A method according to claim 1, wherein the cavities are grooves extending transverse or substantially transverse to the direction of flow of electrolyte over the electrode surface.

6. A method according to claim 1, wherein the wall of each cavity facing the flowing electrolyte is overhung.

7. A method according to claim 1, wherein each cavity has a dimension, measured at its outer end in the direction of flow of the electrolyte, of from 0.5 to 5 mm and a depth of from 1 to 10 mm.

* * * * *